US009026031B2

(12) United States Patent
Ueno et al.

(10) Patent No.: US 9,026,031 B2
(45) Date of Patent: May 5, 2015

(54) MEDIUM ACCOMMODATION CASSETTE, MEDIUM FEEDING DEVICE, AND RECORDING APPARATUS

(75) Inventors: Kohei Ueno, Shiojiri (JP); Yoshikane Tsuchihashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 171 days.

(21) Appl. No.: 13/477,929

(22) Filed: May 22, 2012

(65) Prior Publication Data

US 2012/0301203 A1 Nov. 29, 2012

(30) Foreign Application Priority Data

May 25, 2011 (JP) ..... 2011-116642

(51) Int. Cl.

| | |
|---|---|
| ***B65H 1/00*** | (2006.01) |
| ***B65H 1/04*** | (2006.01) |
| ***B65H 3/06*** | (2006.01) |
| ***B65H 3/52*** | (2006.01) |
| *B65H 1/26* | (2006.01) |

(52) U.S. Cl.

CPC ..... *B65H 3/0684* (2013.01); *B65H 1/266* (2013.01); *B65H 3/5215* (2013.01); *B65H 2405/1117* (2013.01); *B65H 2405/1136* (2013.01)

(58) Field of Classification Search

CPC ..... B65H 1/00; B65H 1/04; B65H 11/00; G03G 15/00; G03G 21/00

USPC ..... 399/393

See application file for complete search history.

(56) References Cited

U.S. PATENT DOCUMENTS

| | | | | |
|---|---|---|---|---|
| 5,232,215 | A * | 8/1993 | Hashimoto et al. | 271/160 |
| 6,123,329 | A * | 9/2000 | Sato et al. | 271/9.01 |
| 6,364,309 | B1 * | 4/2002 | Tomatsu | 271/160 |
| 7,357,586 | B2 * | 4/2008 | Youn | 400/624 |
| 7,614,621 | B2 | 11/2009 | Asada | |
| 8,310,815 | B2 * | 11/2012 | Freeman et al. | 361/529 |
| 8,417,174 | B2 * | 4/2013 | Yamazaki et al. | 399/393 |
| 2007/0138736 | A1 * | 6/2007 | Lien et al. | 271/161 |
| 2008/0048384 | A1 * | 2/2008 | Kusama | 271/145 |
| 2011/0170922 | A1 * | 7/2011 | Kobayashi | 399/393 |

FOREIGN PATENT DOCUMENTS

| | | | | |
|---|---|---|---|---|
| JP | 04298429 | A * | 10/1992 | G03G 15/00 |
| JP | 06227681 | A * | 8/1994 | B65H 1/08 |
| JP | 2006-117362 | | 5/2006 | |
| JP | 2006341971 | A * | 12/2006 | B65H 3/04 |
| JP | 2007-169039 | | 7/2007 | |
| JP | 2010-241535 | | 10/2010 | |

* cited by examiner

*Primary Examiner* — Nguyen Ha
(74) *Attorney, Agent, or Firm* — Workman Nydegger

(57) ABSTRACT

The bottom surface of a paper cassette that supports recording paper is configured of a first bottom surface and a second bottom surface. The second bottom surface is formed of a swing member having a fulcrum at the downstream side in the paper feeding direction and being capable of swinging about the fulcrum with the upstream side in the paper feeding direction serving as a free end, thereby providing a structure in which an angle formed by the second bottom surface and a separation slope increases when the second bottom surface is caused to sink downward by a swing of the swing member.

5 Claims, 6 Drawing Sheets

MEDIUM ACCOMMODATION CASSETTE, MEDIUM FEEDING DEVICE, AND RECORDING APPARATUS

CROSS REFERENCE TO RELATED ART

The disclosure of Japanese Patent Applications No. 2011-116642 filed on May 25, 2011 including specification, drawings and claims is incorporated herein by reference in its entirety.

BACKGROUND

1. Technical Field

The present invention relates to a medium accommodation cassette that accommodates a medium. The invention also relates to a medium feeding device that feeds a medium and a recording apparatus including the medium feeding device.

2. Related Art

In recording apparatuses represented by a facsimile machine, a printer and so on, a paper cassette that is detachably mounted in the main apparatus body is provided in some case. Further, an inner wall opposed to the leading edge of paper in a paper cassette is configured of an inclined wall so as to carry out a function that separates the uppermost sheet of paper to be fed from the other sheets of paper to be subsequently fed in some case.

Further in such a recording apparatus, a feed roller that feeds out paper from a paper cassette is provided at one end side of a rotatable arm (a side distanced from a rotational center of the arm) (for example, JP-A-2006-117362 and Japanese Patent No. 4221609).

However, the configuration as described above has a problem in that, with the increased paper consumption, an angle formed by paper and a line connecting a contact point between the paper and the feed roller and the rotational center of the arm (hereinafter, referred to as "wedge angle") fluctuates so that a paper feed condition becomes unstable.

In order to solve the problem mentioned above, in the feeding device described in Japanese Patent No. 4221609, two feed rollers are provided on the arm so that an appropriate feed roller to make contact with recording paper is selected and used from among those two feed rollers depending on the number of stacked sheets of recording paper. With this configuration, it is possible to suppress the wedge angle from fluctuating to a large extent due to the increased paper consumption, and to feed recording paper in a stabilized manner regardless of the number of stacked sheets of recording paper.

However, in addition to the aforementioned wedge angle, there exist factors that cause paper feed performance to fluctuate. For example, in the case where a distance from the feed roller to an inclined wall at the leading edge of the paper cassette becomes shorter with the rotation of the arm, a region where the leading edge of paper can bend becomes shorter, which generates a state in which the leading edge of paper abuts against the inclined wall and cannot proceed any further (hereinafter, this state is referred to as "non-feed lock state"). In addition, if a friction coefficient between the sheets of paper or a friction coefficient between the paper and the bottom surface of the cassette becomes larger depending on a difference in paper type, a non-feed lock state is generated as well.

Detailed description will be given below with reference to FIG. 6, which is a schematic diagram indicating factors that define a paper feed condition in a configuration such that a feed roller is supported by a rotatable arm.

In FIG. 6, symbol "E" denotes a feed roll and symbol "S1" denotes a rotational center of the arm (not shown). The feed roller E is so configured as to be able to change its position by rotating (swinging) about the rotational center S1.

Symbol "C" denotes a separation slope (inclined wall) provided at a leading edge of tray, symbol "D" denotes the upper surface of recording paper, and symbol "a" denotes an angle (open angle) formed by the separation slope C and the recording paper (bottom surface of cassette). Symbol "S2" denotes a contact point between the feed roller E and the recording paper.

Further, symbol "L" denotes a distance in the horizontal direction from the contact point S2 to the separation slope C, symbol "A" denotes a distance in the horizontal direction between the rotational center S1 and the contact point S2, symbol "B" denotes a distance in the vertical direction between the rotational center S1 and the recording paper, and symbol "r" denotes a rotational direction of the feed roller E respectively. In addition, an angle β denotes an angle (wedge angle) formed by the recording paper (bottom surface of cassette) and a line connecting the rotational center S1 and the contact point S2.

Generally speaking, since the distance L becomes shorter with the increased consumption of recording paper, a risk of occurrence of a non-feed lock state becomes higher with the increased consumption of recording paper.

In particular, once the non-feed lock state as described above has occurred caused by a large difference in friction coefficient between the sheets of paper, it is further difficult to resolve the non-feed lock state due to a wedge effect explained later. In other words, as the feed roller E exerts a feeding force F on the recording paper, the roller receives a reaction force F' against the feeding force F from the recording paper. Accordingly, a moment M about the rotational center S1 acts on the arm supporting the feed roller E due to the reaction force F'. The moment M generates a pressing force W that presses the feel roller E to the recording paper. Accordingly, as the wedge angle β is larger, the pressing force W is larger (hereinafter, this effect is referred to as "wedge effect"), for example.

If a non-feed lock state occurs in which the leading edge of paper abuts against the separation slope C and cannot proceed any further, the reaction force F' is increased resulting in increase in the pressing force W (increase in wedge effect). Accordingly, in the case where a non-feed lock state is caused to occur particularly due to a large friction coefficient between the sheets of paper, adhesion force between the sheets of paper is also strengthened, which will further strengthen the non-feed lock state in an undesirable manner.

If such non-feed lock state occurs, there arises a risk such that a motor that drives the feed roller is overloaded, a train of gears that transmits power from the motor to the feed roller is damaged, and so on. However, these technical issues have not necessarily been taken into consideration in the paper feeding devices described in JP-A-2006-117362 and Japanese Patent No. 4221609. In particular, once a non-feed lock state has occurred, neither of those paper feeding devices can resolve the lock state.

SUMMARY

An advantage of some aspects of the invention is to provide a structure such that a non-feed lock state in which the leading edge of paper abuts against a separation slope and cannot proceed any further can be prevented from occurring and a non-feed lock state can be resolved even if it has actually occurred.

In order to solve the issues mentioned above, a medium accommodation cassette according to a first aspect of the invention includes a bottom surface that supports a medium, and a separation slope which is a slope opposed to the leading edge of the supported medium and separates a medium to be fed from media to be subsequently fed. Further, the bottom surface is so configured as to include a first bottom surface on the upstream side in a medium feeding direction and a second bottom surface on the downstream side in the medium feeding direction. Furthermore, the second bottom surface is formed of a swing member having a fulcrum at the downstream side in the medium feeding direction and being capable of swinging about the fulcrum with the upstream side in the medium feeding direction serving as a free end, thereby providing a structure in which an angle formed by the medium and the separation slope increases when the second bottom surface is caused to sink downward by a swing of the swing member.

According to the first aspect, the bottom surface of a medium accommodation cassette is so configured as to include a first bottom surface on the upstream side in the medium feeding direction and a second bottom surface on the downstream side in the medium feeding direction. Further, the second bottom surface is formed of a swing member and has a structure in which an angle formed by the medium and the separation slope (hereinafter, referred to as "separation angle") increases when the second bottom surface is caused to sink downward by a swing of the swing member, thereby making it possible to prevent a non-feed lock state from occurring. In addition, even if a non-feed lock state has occurred, it can be expected that the leading edge of the medium climbs the separation slope after all so as to resolve the non-feed lock state because the separation angle has increased.

In a second aspect of the invention, the swing member of the first aspect makes the free end thereof be supported by a bias force of a biasing unit and has a structure in which the swing member is caused to swing by a force that the free end receives from the medium against the bias force of the biasing unit.

In a structure where a feed roller configuring a medium feeding unit is supported at the tip of an arm-like member and a distance from the leading edge of a medium to the separation slope becomes shorter with the increased consumption of the medium, a non-feed lock state is likely to occur with the increased consumption of the medium; however, since the wedge effect becomes larger at the same time, the swing member swings gradually against the bias force of the biasing unit so that the separation angle is gradually increased. Accordingly, the occurrence of a non-feed lock state can be prevented in advance.

A medium accommodation cassette according to a third aspect of the invention includes a bottom surface that supports a medium, and a separation slope which is a slope opposed to the leading edge of the supported medium and separates a medium to be fed from media to be subsequently fed. Further, the bottom surface is so configured as to include a first bottom surface on the upstream side in the medium feeding direction and a second bottom surface on the downstream side in the medium feeding direction. Furthermore, the second bottom surface is formed of a flexible member having flexibility and has a structure in which an angle formed by the medium and the separation slope increases when the second bottom surface is caused to sink downward by a bend of the flexible member.

According to the third aspect, the bottom surface of a medium accommodation cassette is so configured as to include a first bottom surface on the upstream side in the medium feeding direction and a second bottom surface on the downstream side in the medium feeding direction. Further, the second bottom surface is formed of a flexible member and has a structure in which the separation angle increases when the second bottom surface is caused to sink downward by a bend of the flexible member, thereby making it possible to prevent the occurrence of a non-feed lock state. In addition, even if a non-feed lock state has occurred, it can be expected that the leading edge of the medium climbs the separation slope after all so as to resolve the non-feed lock state because the separation angle has increased.

A medium accommodation cassette according to a fourth aspect of the invention is a medium accommodation cassette such that the second bottom surface in the medium accommodation cassette according to any one of the first through third aspects is provided at a central portion in a direction intersecting with the medium feeding direction and has a structure in which the second bottom surface forming the central portion sinks downward with both sides of the central portion serving as a fixed bottom surface.

According to the fourth aspect, the second bottom surface is provided at a central portion in a direction intersecting with the medium feeding direction and has a structure in which the second bottom surface forming the central portion sinks downward while both sides of the central portion serving as a fixed bottom surface. Accordingly, the central portion sinks downward at the leading edge of the medium and both the sides are caused to turn upward, thereby making it possible for the leading edge of the medium to climb the separation slope more easily.

A media feeding device according to a fifth aspect of the invention includes the medium accommodation cassette according to any one of the first through fourth aspects, and a feed roller that feeds out a medium accommodated in the medium accommodation cassette from the medium accommodation cassette. With the media feeding device according to the fifth aspect, the same effect can be achieved as that in any one of the first through fourth aspects.

A medium feeding device according to a sixth aspect of the invention includes a bottom surface that supports a medium, a separation slope which is a slope opposed to the leading edge of the supported medium and separates a medium to be fed from media to be subsequently fed, and a medium feeding unit that feeds out the medium supported by the bottom surface. Further, the bottom surface is so configured as to include a first bottom surface on the upstream side in the medium feeding direction and a second bottom surface on the downstream side in the medium feeding direction. Furthermore, the second bottom surface is formed of a swing member having a fulcrum on the downstream side in the medium feeding direction and being capable of swinging about the fulcrum with the upstream side in the medium feeding direction serving as a free end, and has a structure in which an angle formed by the medium and the separation slope increases when the second bottom surface is caused to sink downward by a swing of the swing member.

According to the sixth aspect, same as in the first aspect, the bottom surface of a medium accommodation cassette is so configured as to include a first bottom surface on the upstream side in the medium feeding direction and a second bottom surface on the downstream side in the medium feeding direction. Further, the second bottom surface is formed of a swing member and has a structure in which the separation angle is increased when the second bottom surface is caused to sink downward by a swing of the swing member, thereby making it possible to prevent a non-feed lock state from occurring. In addition, even if a non-feed lock state has occurred, it can be expected that the leading edge of the medium climbs the separation slope after all so as to resolve the non-feed lock state because the separation angle has increased.

A medium feeding device according to a seventh aspect of the invention includes a bottom surface that supports a medium, a separation slope which is a slope opposed to the leading edge of the supported medium and separates a medium to be fed from media to be subsequently fed, and a medium feeding unit that feeds out a medium supported by the bottom surface. Further, the bottom surface is so configured as to include a first bottom surface on the upstream side in the medium feeding direction and a second bottom surface on the downstream side in the medium feeding direction. Furthermore, the second bottom surface is formed of a flexible member having flexibility and has a structure in which an angle formed by the medium and the separation slope increases when the second bottom surface is caused to sink downward by a bend of the flexible member.

According to the seventh aspect, same as in the third aspect, a bottom surface that supports a medium is so configured as to include a first bottom surface on the upstream side in the medium feeding direction and a second bottom surface on the downstream side in the medium feeding direction. Further, the second bottom surface is formed of a flexible member and has a structure in which the separation angle increases when the second bottom surface is caused to sink downward by a bend of the flexible member, thereby making it possible to prevent the occurrence of a non-feed lock state. In addition, even if a non-feed lock state has occurred, it can be expected that the leading edge of the medium climbs the separation slope after all so as to resolve the non-feed lock state because the separation angle has increased.

A recording apparatus according to an eighth aspect of the invention includes a recording unit that performs recording on a medium, and the medium feeding device according to any one of the first through seventh aspects. With the recording apparatus according to the eighth aspect, the same effect can be achieved as that in any one of the first through seventh aspects.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinbelow, an embodiment of the invention will be described with reference to the drawings. It should be noted that an embodiment of the invention is described on the premise that the invention is not limited to the embodiment described below and various kinds of variations on the embodiment can be made without departing from the scope of the invention described in the appended aspects of the invention, and those variations are also included in the scope of the invention.

Figure 1:
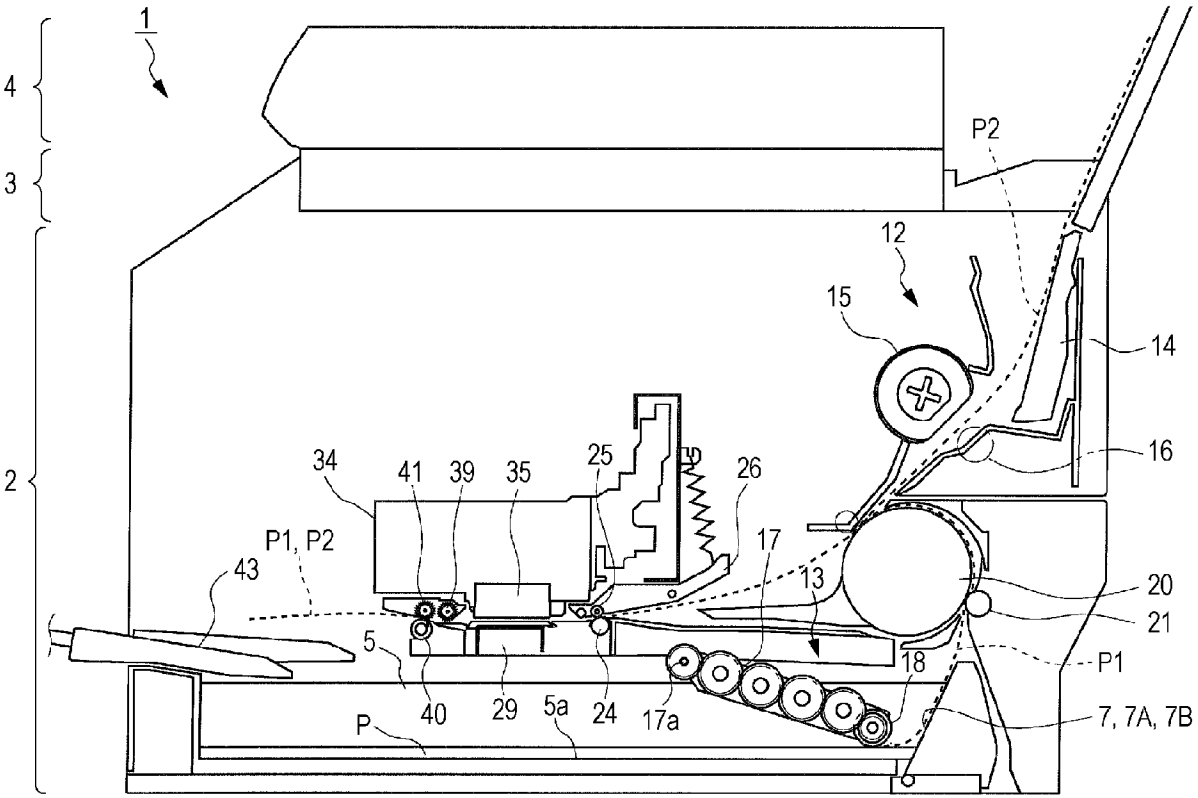
FIG. 1 is a cross-sectional side view illustrating a paper transport path in a printer according to an embodiment of the invention.
Figure 2:
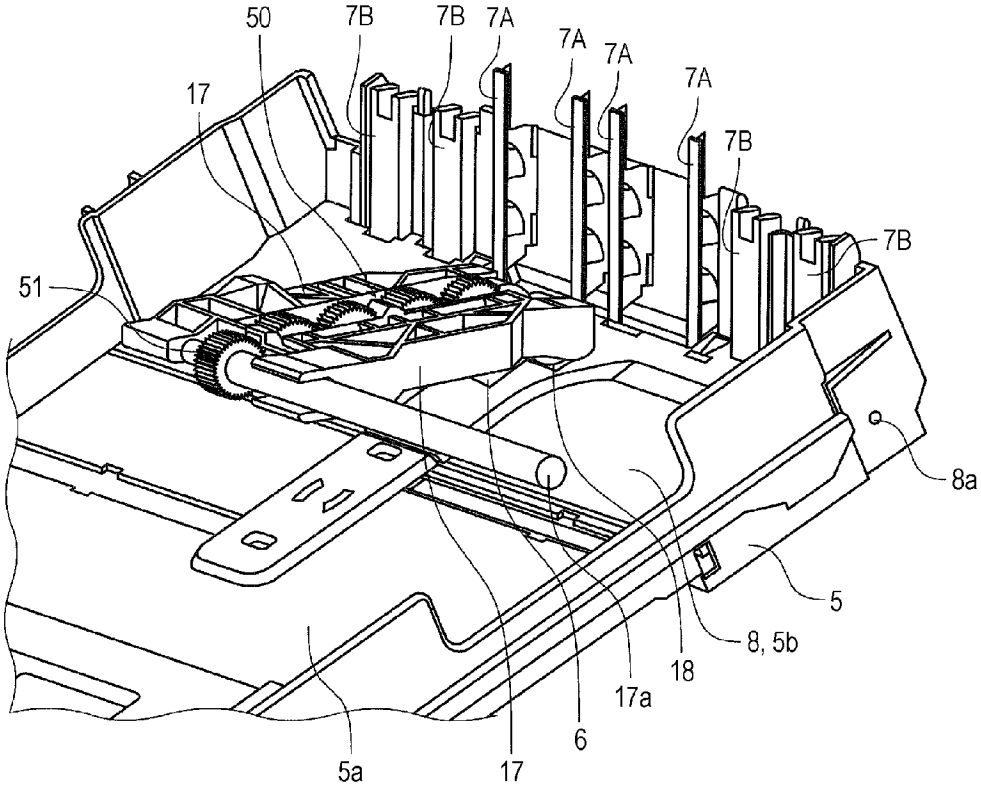
FIG. 2 is a perspective view illustrating a leading edge portion of a paper cassette according to an embodiment of the invention.
Figure 3:
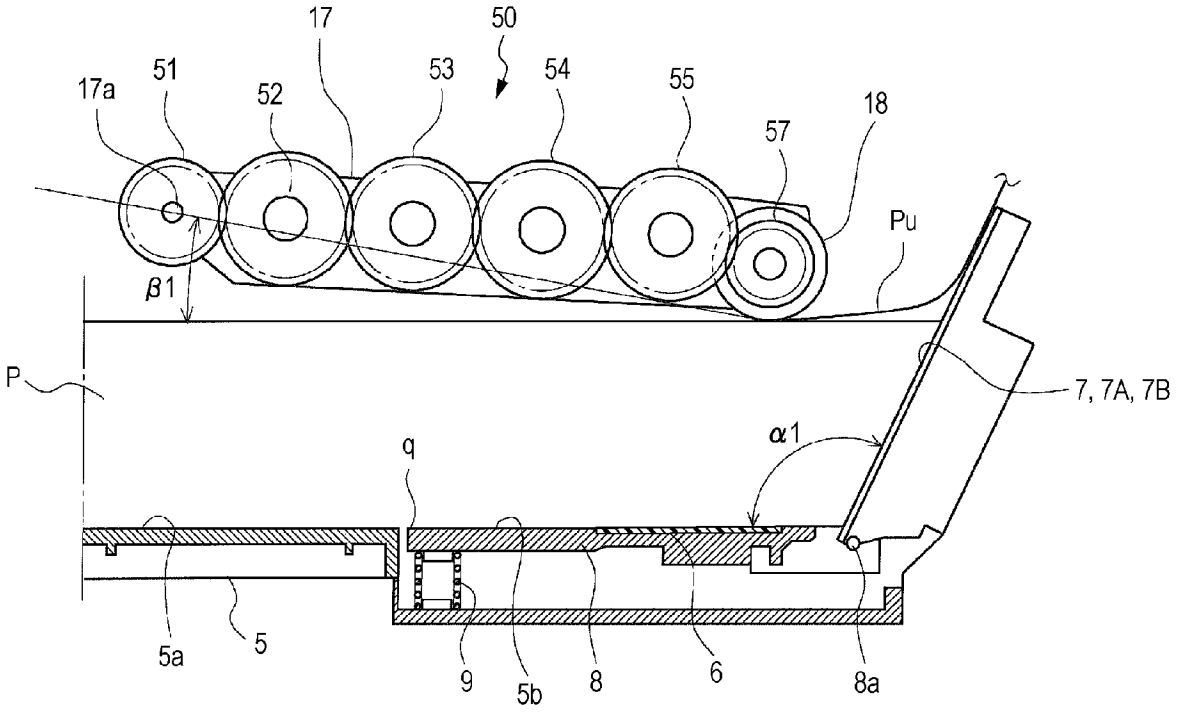
FIG. 3 is a cross-sectional side view illustrating a leading edge portion of a paper cassette according to an embodiment of the invention.
Figure 4:
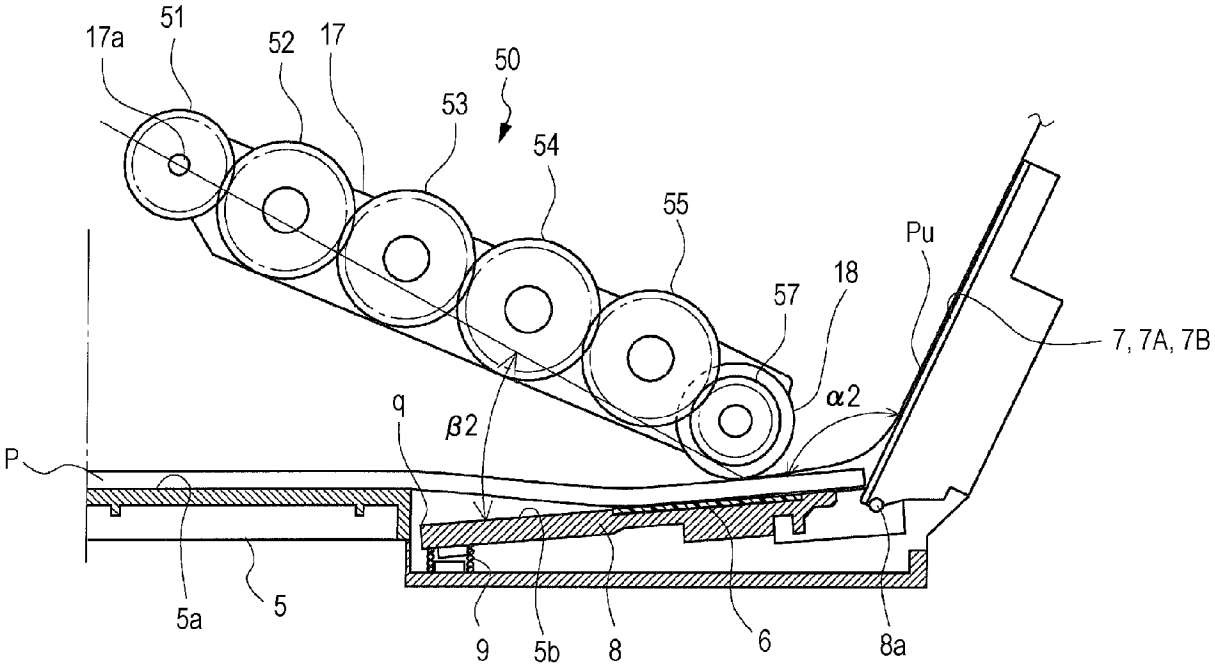
FIG. 4 is a cross-sectional side view illustrating a leading edge portion of a paper cassette according to an embodiment of the invention.
Figure 5:
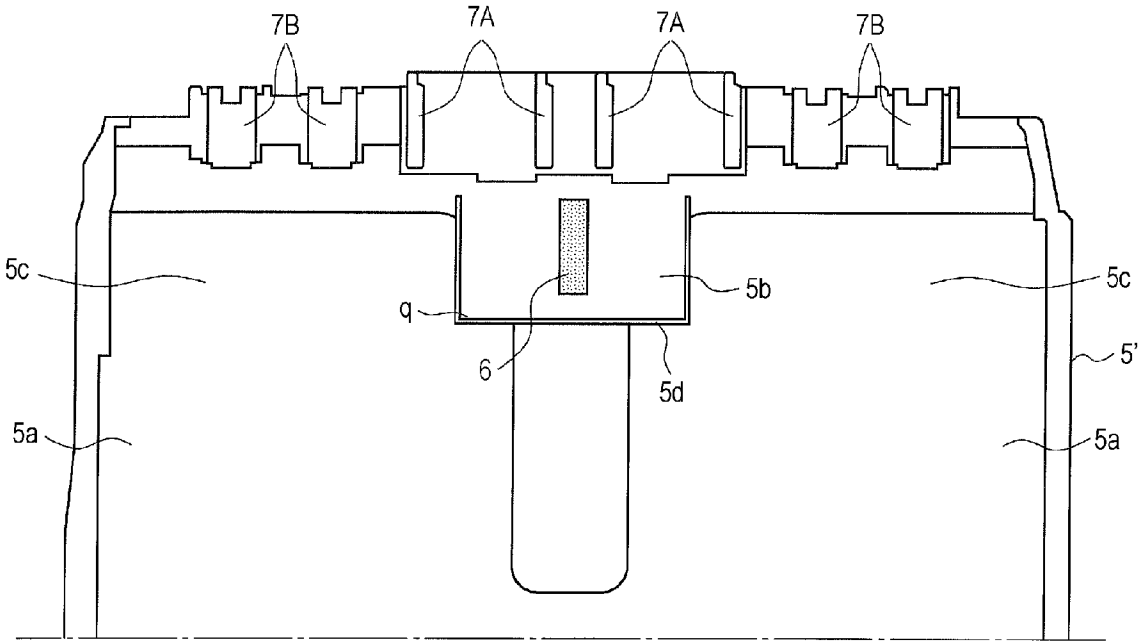
FIG. 5 is a plan view illustrating a leading edge portion of a paper cassette according to another embodiment of the invention.

FIG. 1 is a cross-sectional side view schematically illustrating an ink jet printer 1 as an example of a recording apparatus according to the invention, FIG. 2 is a perspective view illustrating a leading edge portion of a paper cassette 5 which is an embodiment of a medium accommodation cassette according to the invention, FIGS. 3 and 4 are cross-sectional side views illustrating a leading edge portion of the paper cassette 5, and FIG. 5 is a plan view illustrating a paper cassette 5' according to another embodiment of the invention.

First, the general description of the overall configuration of the ink jet printer 1 will be given. In FIG. 1, symbol "2" denotes a recording unit that performs ink jet recording on recording paper as an example of a medium, symbol "3" denotes a scanner unit provided on the upper side of the recording unit 2, and symbol "4" denotes an automatic document transport unit provided on the upper side of the scanner unit 3, respectively. That is, the ink jet printer 1 is configured as a complex machine equipped with a scanner function in addition to an ink jet recording function.

In the lower portion of the apparatus, symbol "5" denotes a detachable paper cassette in which recording paper is set, and symbol "43" denotes a discharged-paper reception tray that receives discharged recording paper. The recording unit 2 includes two paper feeding paths: one is a paper feeding path extended from a second paper feeder unit 13 which is provided in the lower portion of the apparatus and is an embodiment of the medium feeding device according to the invention, the other is a paper feeding path extended from a first paper feeder unit 12 which is provided at the rear side of the apparatus. Note that a broken line P1 indicates a transport route of the recording paper fed out from the second paper feeder unit 13, meanwhile a broken line P2 indicates a transport route of the recording paper fed out from the first paper feeder unit 12.

In the second paper feeder unit 13, a first feed roller 18 forming a paper feeding unit is provided at a position facing the paper cassette 5. The first feed roller 18 is supported in a rotatable manner by a roller supporter 17 that is swingable about a rotational shaft 17*a*, and can advance or retreat with respect to the paper cassette 5 driven by a swing movement of the roller supporter 17. The first feed roller 18 makes contact with the uppermost sheet of recording paper P accommodated in the paper cassette 5 and rotates while making contact with the uppermost sheet, and thus feeds out the uppermost sheet of recording paper P to the downstream side.

Recording paper P having been fed out by the first feed roller 18 is bent and reversed by a large-diameter reverse roller 20, thereafter reaches a transport driving roller 24 and a transport driven roller 25 serving as a transport unit. Note that symbol "21" denotes a separation roller that separates paper by nipping the paper with the reverse roller 20.

On the other hand, in the first paper feeder unit 12 provided at the upper rear side of the recording unit 2, a support member 14 supports recording paper in an inclined posture and press-contacts the uppermost sheet of stacked paper to a feed roller 15 by swinging about a swing shaft (not shown) on the upper side. The feed roller 15 feeds out the press-contacted paper to the downstream side with its rotation. Note that symbol "16" denotes another separation roller that separates paper by nipping the paper with the feed roller 15.

The transport driving roller 24 and the transport driven roller 25 are paired rollers that precisely feed recording paper P to the downstream side. On the downstream side of this pair of rollers, an ink jet recording head 35 and another support member 29 that guides paper to the downstream side are disposed facing each other.

The recording head 35 is installed on a bottom portion of a carriage 34 that can move back and forth in a direction perpendicular to a paper transport direction (a front/back direction with respect to the plane of paper on which FIG. 1 is drawn: hereinafter, referred to as "main scanning direction" as is needed), and performs recording by discharging ink onto recording paper P while moving in the main scanning direction.

On the downstream side of the recording head 35, symbol "39" denotes a driven roller that prevents recording paper P from rising up, symbol "40" denotes a discharge driving roller that discharges recording paper P by its rotation, and symbol "41" denotes a discharge driven roller that nips recording paper P with the discharge driving roller 40. Recording paper P on which recording has been performed is discharged toward the discharged-paper reception tray 43 by the pair of rollers.

The ink jet printer 1 does not discharge recording paper P on the front surface (first surface) of which recording has been performed toward the discharged-paper reception tray 43, but feeds the recording paper P backward so as to bend and reverse it by the reverse roller 20, thereby making it possible to perform printing on the back surface (second surface).

The overall configuration of the ink jet printer 1 has been described thus far. Hereinafter, the second paper feeder unit 13, specifically the paper cassette 5 included therein will be described in detail.

As shown in FIGS. 2 through 4, the paper cassette 5 is configured so that its bottom surface has a first bottom surface 5*a* on the upstream side in the paper feeding direction (left side in FIGS. 3 and 4) and a second bottom surface 5*b* on the downstream side in the paper feeding direction (right side in FIGS. 3 and 4).

At the leading edge side of recording paper P supported by the first bottom surface 5*a* and the second bottom surface 5*b*, separation slopes 7A and separation slopes 7B are disposed opposing each other. In this embodiment, although a friction coefficient of the separation slope 7A with the leading edge of the paper is set larger than that of the separation slope 7B, the invention is not limited thereto and both the friction coefficients may be set to have the same value. In the following description, the separation slopes 7A and 7B are collectively called a "separation slope 7" unless they are needed to be specifically distinguished.

The separation slope 7 forms a predetermined open angle (separation angle) α with the second bottom surface 5*b* (α1 in FIG. 3, α2 in FIG. 4: both are greater than 90°); the leading edge of the uppermost sheet of recording paper P is fed while making contact with and sliding across the separation slope 7, thereby making it possible to avoid duplicate transport of sheets of recording paper P to be subsequently fed.

In FIGS. 3 and 4, an angle β (β1 in FIG. 3, β2 in FIG. 4) represents an angle formed by recording paper P (or the second bottom surface 5*b*) and a line connecting the axial center of the rotational shaft 17*a* and a position at which the first feed roller 18 makes contact with the recording paper P; that is, the angle β represents a wedge angle. Further in FIGS. 3 and 4, symbol "Pu" denotes the uppermost sheet of recording paper to be fed.

On the second bottom surface 5*b*, a holding pad 6 (made of rubber, cork or elastomer, for example) that gives a large friction coefficient with recording paper P is provided at a position opposing the first feed roller 18. With this holding pad 6, recording paper P is prevented from being fed out in a bundle of multiple sheets of paper at the time of paper feeding.

As described above, the first feed roller 18 is supported by the roller supporter 17, and the roller supporter 17 swings about the rotational shaft 17*a*. A first gear 51 is fixed to an end of the rotational shaft 17*a*, and a plurality of gears are arranged following the first gear 51 as a starting point toward the first feed roller 18, thereby configuring a power transmission unit 50. It is to be noted that the power of a motor (not shown) as a driving source is transmitted to the other end of the rotational shaft 17*a*, by which the rotational shaft 17*a* (together with the first gear 51) is rotated.

The power transmission unit 50 is so configured as to include the first gear 51, a second gear 52, a third gear 53, a fourth gear 54, a fifth gear 55, and a sixth gear 57. The sixth gear 57 transmits power to the rotational shaft of the first feed roller 18.

The roller supporter 17 is structured so as to locate on both sides sandwiching the above train of gears in the axis line direction of the rotational shaft 17*a*, and one end side thereof is supported in a rotatable manner by the rotational shaft 17*a* so as to rotate relative to the rotational shaft 17*a*. With this structure, the gears and the first feed roller 18 are supported by the roller supporter 17. Although not shown, the first feed roller 18 is provided on both sides of the gears in the axis line direction of the rotational shaft 17*a*.

The second bottom surface 5*b* configuring the bottom surface of the paper cassette 5 is formed of a plate-like swing member 8. The swing member 8 includes a swing shaft (fulcrum) 8*a* at the downstream side in the paper feeding direction and is so structured as to be swingable about the swing shaft 8*a* with the upstream side thereof in the paper feeding direction serving as a free end (denoted by symbol "q" in FIGS. 3 and 4) in the clockwise and counterclockwise directions in FIGS. 3 and 4. When the swing member 8 swings, the second bottom surface 5*b* is caused to sink downward in the manner as the change from FIG. 3 to FIG. 4 indicates, and then the angle α formed by the second bottom surface 5*b* and the separation slopes 7A, 7B increases as a result.

A coil spring 9 as a biasing unit is provided at the free end q side of the swing member 8. The swing member 8 is provided in a state such that the second bottom surface 5*b* is biased to the opposite direction with respect to the direction in which the second bottom surface 5*b* is caused to sink. With this structure, the first bottom surface 5*a* and the second bottom surface 5*b* are approximately flush with each other at the time the feeding of recording paper P is not carried out.

Figure 6:
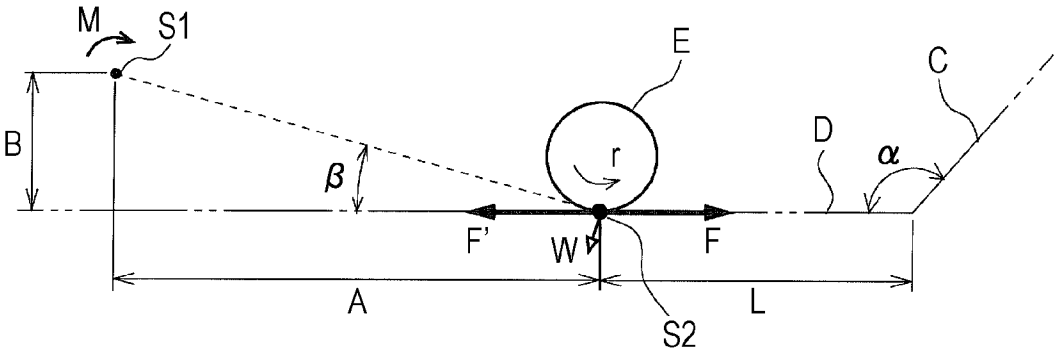
FIG. 6 is a schematic diagram indicating factors that define a paper feed condition in a configuration in which a feed roller is supported by an arm.

FIG. 3 illustrates a state in which the number of sheets of stacked recording paper P is at its maximum. The wedge angle β (β1) is the smallest in this state, and a force with which the first feed roller 18 presses a bundle of paper in accordance with the wedge angle β (wedge effect: pressing force W indicated in FIG. 6) is also the smallest. Accordingly, the swing member does not swing, and the first bottom surface 5*a* and the second bottom surface 5*b* are flush with each other (α1 is a separation angle).

As recording paper P is consumed in this state, a distance from the leading edge of the paper to the separation slope 7 becomes gradually shorter so that a non-feed lock state is likely to occur. However, because the wedge angle β becomes gradually larger and the wedge effect (a force of the first feed roller 18 that presses a bundle of paper) also becomes larger, the recording paper P (first feed roller 18) presses the swing member 8 down to the lower side against a bias force of the coil spring 9.

As the second bottom surface 5*b* is caused to sink downward in the manner described above, the separation angle α increases, thereby making it possible for the leading edge of the paper to climb the separation slope 7 with ease. Accordingly, the occurrence of a non-feed lock state can be prevented even if a distance from the leading edge of the paper to the separation slope 7 becomes shorter. Note that FIG. 4 indicates a state such that recording paper P has considerably been consumed (α2 is a separation angle (α2>α1)).

Furthermore, even if a non-feed lock state has occurred, a reaction force that the first feed roller 18 receives from the paper becomes larger and the wedge effect also becomes larger, whereby the second bottom surface 5*b* is caused to sink further to the lower side; this makes the separation angle α larger, and as a result, the leading edge of the paper can climb the separation slope 7. That is to say, even if a non-feed lock state has occurred, the lock can be resolved after all.

With the configuration described above, various kinds of troubles (for example, damage to the train of gears configuring the power transmission unit 50) can be prevented appropriately.

In particular, the ink jet printer 1 according to the embodiment has such a configuration that the first feed roller 18 and the transport driving roller 24 are both driven by a single motor. Accordingly, if a non-feed lock state of recording paper occurs when the feeding of paper is additionally attempted during the paper transport by the transport driving roller 24 (i.e., during the execution of recording), the precision of paper-feeding carried out by the transport driving roller 24 is lowered due to an increased load on the motor; this can cause a risk to arise such that recording quality is lowered. However, since the non-feed lock state is appropriately resolved in the manner as described above, such risk will not arise.

In the aforementioned embodiment, although the invention is applied to the paper cassette 5, the invention can also be applied to a medium feeding device without a paper cassette (for example, a medium feeding device configured so that paper is directly set in the device by manual operation).

In the aforementioned embodiment, the device is so configured that the second bottom surface 5*b* is caused to sink downward by a swing of the swing member 8, thereby making the separation angle α increase. However, the device may be configured so that the second bottom surface 5*b* is caused to sink downward by a bend of a flexible member.

FIG. 5 shows an example of such an embodiment. A paper cassette 5' in FIG. 5 is formed with a resin material, and a slit 5*d* is formed in approximately a rectangle shape with its one side opened at a center portion of the bottom surface of the paper cassette 5'. The inner side of the slit 5*d* serves as the second bottom surface 5*b*, and the inner side of the slit 5*d* is made to elastically deform by the pressure from paper so that the second bottom surface 5*b* sinks downward to increase the separation angle α (note that both sides of the second bottom surface 5*b* serve as a fixed bottom surface).

Accordingly, the center portion sinks downward at the leading edge of the paper and both the sides are caused to turn upward, thereby making it possible for the leading edge of the paper to climb the separation slope 7 more easily. It is to be noted that in FIG. 5, the same configurations as those having already been described are assigned the same symbols and the description thereof is omitted hereinbelow.

In the embodiment as shown in FIG. 5, although the device is so configured that the center portion (second bottom surface 5*b*) is caused to sink downward by a bend of the bottom surface of the paper cassette 5', configurations are not limited to the configuration in which the center portion is caused to sink downward, and a configuration in which the whole bottom surface including both the sides is caused to sink downward may be employed. In addition, as in the embodiment having been described referring to FIGS. 3 and 4, the device may be configured so that the center portion (second bottom surface 5*b*) is caused to sink downward by a swing of the swing member.

Further, in the aforementioned embodiments, as the wedge angle β becomes larger, the second bottom surface 5*b* sinks gradually to the lower side. However, the device may have a configuration such that the second bottom surface 5*b* does not sink downward until a force received by the second bottom surface 5*b* reaches a predetermined value, and the second bottom surface 5*b* sinks downward when the force received by the second bottom surface 5*b* exceeds a predetermined value.

Furthermore, in the aforementioned embodiments, the second bottom surface 5*b* is so configured as to be pushed down to the lower side by the bend of paper when a state such that the leading edge of the paper abuts against the separation slopes 7A, 7B and cannot proceed any further to the downstream side (non-feed lock state) occurs. However, the device may be configured so that, for example, the swing member 8 is structured to be swung by driving force of a motor, a detection unit for detecting the occurrence of a non-feed lock state is provided, and then the swing member 8 is swung by the driving force of the motor (causing the second bottom surface 5*b* to sink downward) when the detection unit detects the occurrence of a non-feed lock state.

The detection unit for detecting the occurrence of a non-feed lock state can be configured of a paper-passing detection unit that is provided downstream of the separation slopes 7A, 7B and detects the passing of paper, for example. That is to say, if the paper-passing detection unit does not detect the passing of paper after a predetermined period of time has elapsed since the start of paper-feeding by the first feed roller 18, it can be determined that a non-feed lock state has occurred. On the other hand, a load (value of a driving current) exerted on a motor that drives the first feed roller 18 increases when a non-feed loch state occurs; therefore, if an increase in the load is detected, it may be determined that a non-feed lock state has occurred and the swing member 8 will be made to be swung.

What is claimed is:

1. A medium feeding device comprising:

a bottom surface that supports a medium;

a separation slope which is a slope opposed to the leading edge of the supported medium and separates a medium to be fed from media to be subsequently fed; and a medium feeding unit that feeds out a medium supported by the bottom surface in a medium feeding direction, the medium feeding unit being swingably supported by a rotational shaft and a feeding unit supporter, the rotational shaft being located upstream of the medium feeding unit in the medium feeding direction, a reaction force, opposite to a force applied by the medium feeding unit towards the medium, being opposite to the medium feeding direction, wherein the bottom surface is so configured as to include a first bottom surface on the upstream side in the medium feeding direction and a second bottom surface on the downstream side in the medium feeding direction, and the second bottom surface is formed of a swing member having a fulcrum on the downstream side of the bottom surface in the medium feeding direction, at an upstream side of the separation slope in the medium feeding direction, and being capable of swinging about the fulcrum with the upstream side in the medium feeding direction serving as a free end, and has a structure in which an angle formed by the medium and the separation slope increases when the second bottom surface is caused to sink downward by a swing of the swing member.

2. The medium feeding device according to claim 1, wherein the swing member makes the free end thereof be supported by a bias force of a biasing unit and has a structure in which the swing member is caused to swing by a force that the free end receives from the medium against the bias force of the biasing unit.

3. The medium feeding device according to claim 1, wherein the second bottom surface is provided at a central portion with respect to a direction intersecting with the medium feeding direction, and the second bottom surface has a structure in which the second bottom surface forming the central portion sinks downward with both sides of the central portion serving as a fixed bottom surface.

4. The medium feeding device according to claim 1, further comprising a feed roller that feeds out a medium accommodated in a medium accommodation cassette from the medium accommodation cassette.

5. A recording apparatus comprising:

a recording unit that performs recording on a medium; and the medium feeding device accordingly to claim 1.

* * * * *